US005332887A

United States Patent [19]

Shiaw-Shing

[11] Patent Number: 5,332,887

[45] Date of Patent: Jul. 26, 1994

[54] ELECTRIC THERMOS BOTTLE CAPABLE OF AUTOMATIC WATER RELEASE AND WATER CUTOFF

[76] Inventor: Yuan Shiaw-Shing, 4th Fl., 29, 127 Alley, Lin Sen Rd., Guei Shan Shiang, Taoyuan County, Taiwan

[21] Appl. No.: 769,241

[22] Filed: Oct. 1, 1991

[51] Int. Cl.[5] ..... H05B 1/02; B67D 5/62; B05B 7/00

[52] U.S. Cl. ..... 219/518; 392/444; 392/471; 222/146.5; 222/630

[58] Field of Search ..... 392/444, 445, 447, 471; 222/64–66, 146.1, 146.5, 209, 401, 630, 631; 219/518

[56] References Cited

U.S. PATENT DOCUMENTS

| | | | |
|---|---|---|---|
| 2,013,172 | 9/1935 | Petrone | 219/518 |
| 2,346,389 | 4/1944 | Peters | 219/518 |
| 3,079,485 | 2/1963 | Groves | 392/447 |
| 3,422,745 | 1/1969 | Eisendrath | 219/518 |
| 3,537,384 | 11/1970 | Stauber | 392/471 |
| 3,604,594 | 9/1971 | Isreeli | 222/64 |
| 4,030,634 | 6/1977 | Osborn | 222/64 |
| 4,116,246 | 9/1978 | Franzen | 222/146.5 |
| 4,116,366 | 9/1978 | Takenakashima | 222/209 |
| 4,517,445 | 5/1985 | Tatsumi | 392/444 |
| 4,953,751 | 9/1990 | Shannon | 222/64 |

*Primary Examiner*—Bruce A. Reynolds
*Assistant Examiner*—Michael D. Switzer
*Attorney, Agent, or Firm*—Bacon & Thomas

[57] ABSTRACT

An electric thermos bottle capable of automatic water release/cutoff which has an automatic water release/-cutoff power switch turned on by the weight of a cup placed thereon. When the power switch is on, it actuates an electric air pump inside the top head of the thermos bottle to produce compressed air which passes an air communicating pipe and enters the sealed thermos bottle. At this point, the air pressure in the thermos bottle suddenly increases and therefore, forces water reserved in the thermos bottle to automaticaly release from a blow off pipe before flowing into the cup below a water exit. When water in the cup reaches a predetermined level, the water completes an override circuit which includes conductive elements in the cup and the metal interior of the thermos, in order to disconnect the air pump and automatically discontinue the release of water. An air valve is located above the air communicating pipe and will automatically open when the release of water is discontinued to thereby form a steam passage which prevents water reserved in the thermos bottle from overflowing.

6 Claims, 3 Drawing Sheets

ELECTRIC THERMOS BOTTLE CAPABLE OF AUTOMATIC WATER RELEASE AND WATER CUTOFF

BACKGROUND OF THE INVENTION

The present invention relates to an automatic water release/cutoff electric thermos bottle of which a special internal structure not only provides the thermos with the function of automatically releasing or cutting off reserved water, but also prevents water in the thermos from overflowing despite being constantly under high temperature and pressure.

Currently, the electric thermos bottles available in the market are generally the hand-pressing type. The shortcomings of this type of thermos bottles includes:

1. Users' hands are frequently injured by high tempertured steam leaking from the thermos when they pump water therein; and 2. The poor airtight condition of the thermos frequently causes inconvenience.

In response, the inventor has developed an electric thermos bottle which eliminates the above-mentioned shortcomings of conventional electric thermos bottles, As a result, our quality of life is upgraded, and the safety and convenience of electric thermos bottles is enhanced.

SUMMARY OF THE INVENTION

The primary object of the present invention is to provide an electric thermos bottle inside which an electric air pump, an air communicating pipe, an air valve, an automatic water release/cutoff circuit, etc. are disposed. The air pump is used to supply compressed air which enters into the thermos via the air communicating pipe. The air valve is controlled by a relay and is provided above the air communicating pipe. Furthermore, a power switch for automatically releasing and cutting off water is provided in front of the thermos for actuating the air pump and controlling the opening or closing of the air valve. Under the weight of a specially designed cup positioned on it, the power switch for automatically releasing and cutting off water activates the above mentioned components by causing, the air pump to supply compressed air, the air valve to close, and the water reserved in the thermos to automatically releases due to the increased air pressure. However, when the specially designed cup is removed from the power switch for automatically releasing or cutting off water, the air valve opens, the electric air pump stops supplying compressed air, and the thermos recovers to its original shutoff condition. Since the specially designed cup is provided with conductive material, when it is positioned on the power switch for automatically releasing and cutting off water with a predetermined amount of water in it, the air pump will be automatically turned off to automatically stop the release of water from the thermos.

Another object of the present invention is to provide an electric thermos bottle as above-described, wherein, when the cup is removed from the power switch for automatically releasing and cutting off water, the air valve automatically opens, permitting the air communicating pipe to be a steam passage which communicates with the outside air. In this way, the steam formed by the boiled water in the thermos may properly escape from the thermos without reaching a critical point of air pressure in the thermos and causing any undesirable overflow of the reserved water from the water outlet of the thermos.

It is a further object of the present invention to provide an electric thermos bottle as above-described, wherein a safety switch is provided in front of the thermos to prevent any injury, such as burning by boiled water in the thermos or shock by electric curent, caused by careless touches of the power switch by small children.

BRIEF DESCRIPTION OF THE DRAWINGS

The present invention can be best understood by referring to the following description of preferred embodiments and the accompanying drawings, wherein.

DETAILED DESCRIPTION OF THE PREFERRED EMBODIMENTS

Figure 1:
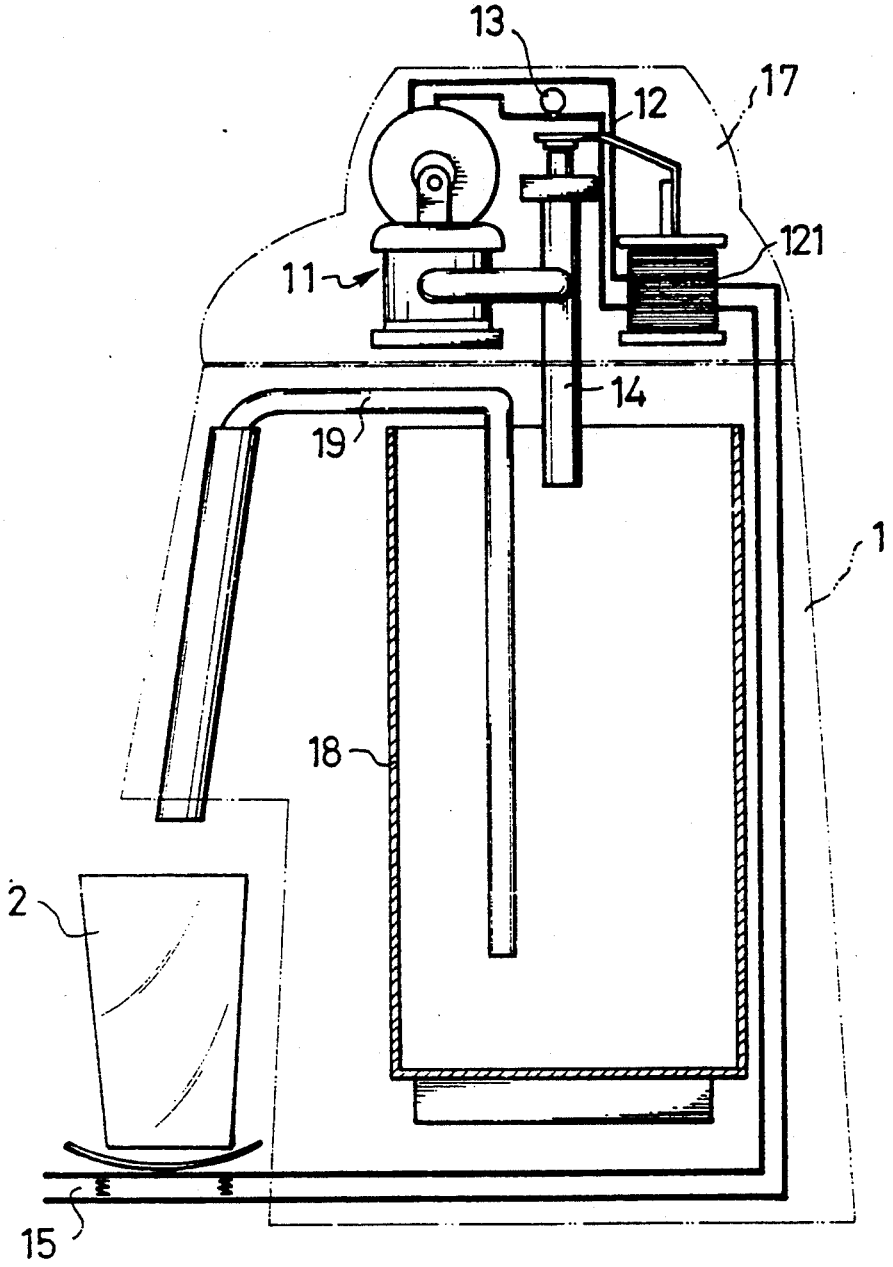
FIG. 1 shows the internal structure of the present invention.

Please refer to FIG. 1. The present invention mainly consists of a thermos bottle 1, an electric air pump 11, an air valve 12, an indicating lamp 13, a—| -shaped air communicating pipe 14, an automatic water release/-cutoff power switch 15, and a safety switch 16.

The electric air pump 11 is provided inside a top head 17 of the thermos bottle 1 and communicates with the air communicating pipe 14. Compressed air produced by the electric air pump 11 may pass the air communicating pipe 14 and enters into the metal inner part 18 of the thermos bottle 1.

The air valve 12 is also provided inside the top head 17 of the thermos bottle 1 at a position above the top end of the air communicating pipe 14. A relay 121 is used to control the opening and closing of the air valve 12. When the electric air pump 11 is actuated to operate, the air valve closes at the same time so that a closed pipeline is formed between the air communicating pipe 14 and the inner part 18 of the thermos bottle 1. When the electric air pump 11 is off and stops supplying compressed air, the relay 121 causes the air valve 12 to open, permitting the air communicating pipe 14 to communicate with the air outside the thermos bottle 1 and forms a steam exhaust passage there.

The automatic water release/cutoff power switch 15 is provided in front of the thermos bottle 1 at a proper position. Since it is a gravity switch, a cup 2 positioned thereon causes it to be switched on and thereby actuate the electric air pump 11 to operate and close the air valve 12. At this point, the indicating lamp 13 above the top head 17 lights, indicating that the thermos bottle 1 is now in a water releasing state. When the cup 2 is removed, the automatic water release/cutoff power switch 15 is off and the electric air pump 11 stops supplying compressed air, the air valve 12 automatically opens, and the indicating lamp 13 extinguishes. From the above, it is understood that the automatic water relaese/cutoff power switch 15 is the key for controlling the automatic water release/cutoff function of the thermos bottle 1.

Figure 2:
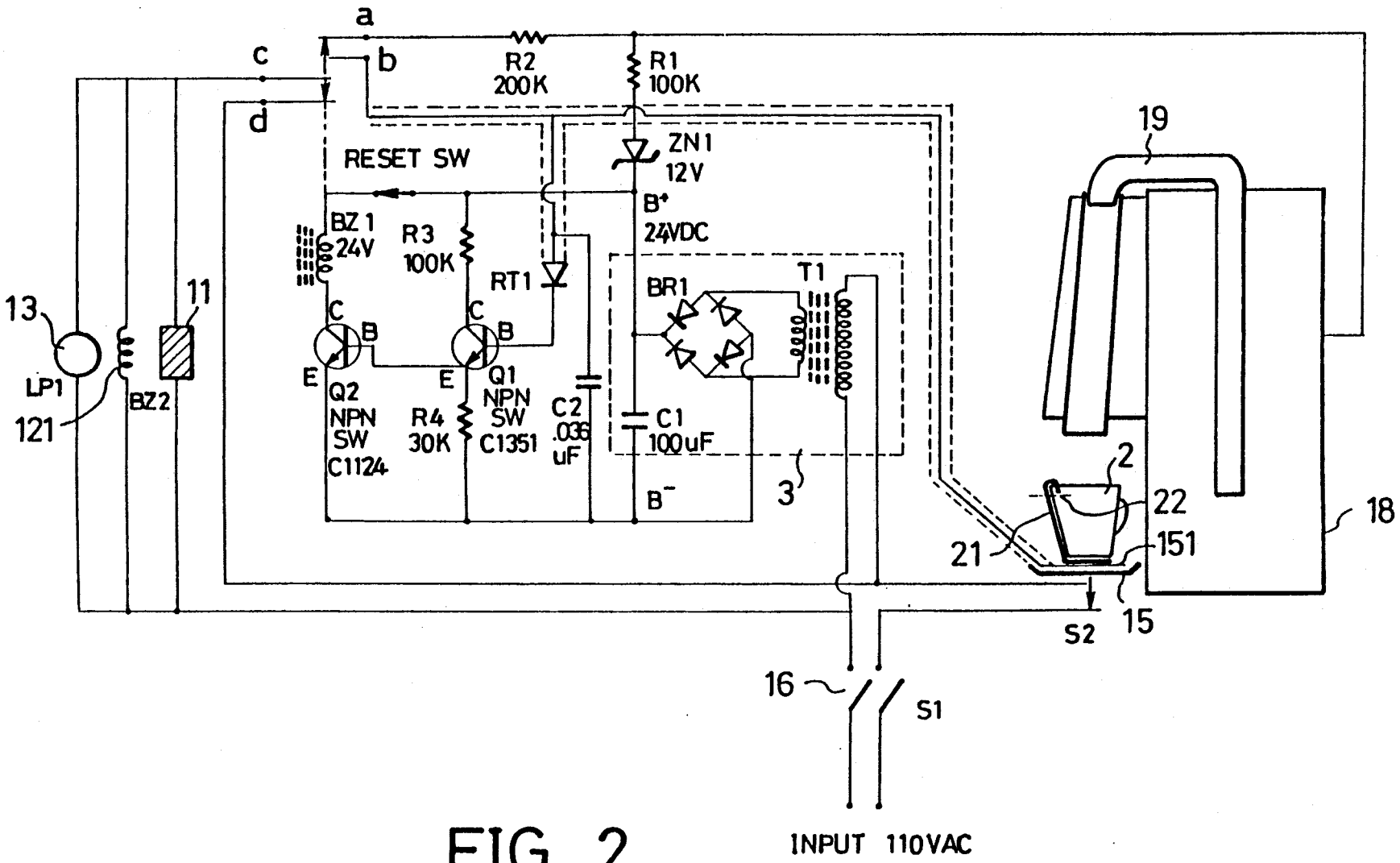
FIG. 2 is a block diagram of the circuit of the present invention.

Please refer to FIG. 2. The safety switch 16 is a double-pole switch provided on top of the top head 17.

When it is turned off, the automatic water release/cutoff power switch 15 is disconnected, and the above described water releasing or cutting off operations cannot be performed in no way. For those families having small children, the safety switch 16 should always be turned off to prevent any accident, such as overflow of boiled water from the thermos bottle 1 and unexpected shock, caused by careless touch of the automatic water release/cutoff power switch 15 by the children.

Figure 3:
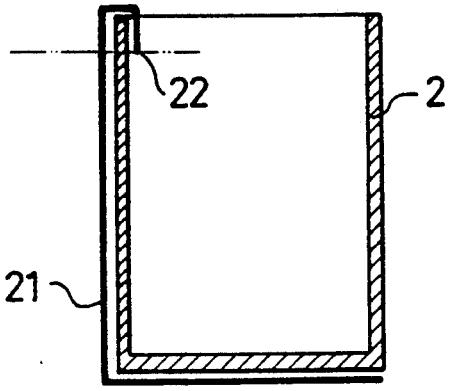
FIG. 3 shows a preferred embodiment of the specially designed cup of the present invention.

According to an especially preferred embodiment of the invention, the cup 2 itself constitutes one of the components of the control circuit and is therefore specially designed. Please refer to FIGS. 3 and 4. The cup 2 shown in FIG. 3 is a porcelain cup which has a thick layer of glaze 21 applied on its outer bottom and the periphery of the bottom; another long strip of glaze 21 about 0.5 cm in width is applied, beginning from the periphery of the outer bottom, extending upward along the cup's outer wall, crossing the rim of the cup 2 and extending into the inner wall of the cup 2, and finally stopping at a high level mark 22 inside the cup 2. When the cup 2 is filled with water, it becomes a conductor and is capable of controlling the on and off of the automatic water release/cutoff power switch 15.

Figure 4:
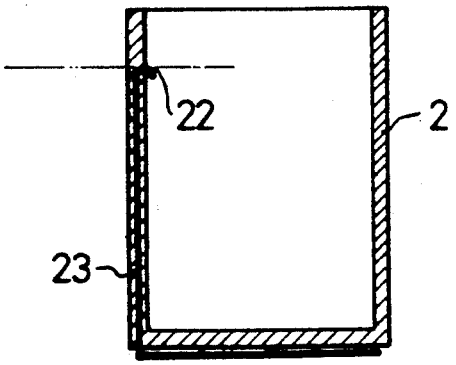
FIG. 4 shows another preferred embodiment of the specially designed cup of the present invention.

The cup shown in FIG. 4 is a glass cup in which an alloy wire 23 is used to replace the glaze 21 as used in a porcelain cup. The alloy wire 23 is inset inside the glass wall of the cup 2 with a short length of it exposed at both the outer bottom and the high level mark 22 of the cup 2, separately, to facilitate the conduction of electric current.

Please refer to FIG. 2 for the circuit controlling the present invention. A power supply circuit 3 consists of a transformer T1, a rectifier BR1, and a rectification capacitor Cl, capable of providing 24V DC power; a control circuit is amplified through transistors Q1 and Q2, having a sensitivity of 0.0000024V. A relay BZ1 is used to control the power input of the electric air pump 11, the relay 121 for the air valve 12, and the indicating lamp 13. The 24V DC power B+ is connected to the metal housing 18 of the thermos bottle 1 via zener diode ZN1 and resistor R1.

The base electrode B of transistor Q1 is conected to a metal plate 151 positioned on the automatic water release/cutoff power switch 15 via a diode RT1 (but there is insulation between the metal plate 151 and the power switch 15) and connected to point B of the relay BZ1.

When the transistor Q1 is switched on, points a and b of the relay BZ1 connect, B+ is transmitted to the base electrode B of transistor Q1 via zener diode ZN1, points a and b of BZ1, and diode RT1, so that the B electrode of Q1 still maintains a positive charge, both transistors Q1 and Q2 are kept in an on state, and the relay BZ1 is kept on until the cup 2 is removed from the automatic water release/cutoff power 15, thus forming a self-holding circuit for the present invention.

In addition, a second capacitor C2, together with the diode RT1 and a shielded cable as shown in FIG. 2, form a noise-silencing signal circuit. Since any noise signal sensed by this circuit is either shielded by the shielding cable, or, a repulsive negative signal is produced by connecting capacitor C2 to diode RT1 directly, the B electrode of transistor Q1 can be protected from interference by noise signals which might cause the automatic water cutoff function of the present invention to fail.

The following is a description of the operation of a preferred embodiment of the present invention as well as an analysis of the circuit thereof:

When the safety switch 16 is set to ON and the specially designed cup 2 is placed on the automatic water release/cutoff power switch 15, the 24V DC power supply circuit 3, the electric air pump 11, the relay 121 (also BZ2) for the air valve 12, and the indicating lamp 13 (also LP1) are turned on simultaneously. At this point, the indicating lamp 13 (also LP1) lights, the relay 121 (also BZ2) for the air valve 12 holds in an on-position to keep the air valve 12 closed, the 24V DC power supply circuit 3 outputs 24V DC power to actuate the electric air pump 11 (also PP1) so that the latter supplies compressed air and pumps the same into the thermos bottle 1 via the air communicating pipe 14. As a result, the pressure inside the thermos bottle 1 suddenly increases and forces water reserved therein to be poured into the cup 2 via a blow off pipe 19 in the thermos bottle 1, as shown in FIG. 1. When water poured into the cup 2 reaches upward to the high level mark 22, an electric circuit is formed, beginning from the B electrode of transistor Q1, through the diode RT1, the metal plate 151, the glaze 23 applied on the outer bottom of the cup 2, glaze 23 applied on the outer wall of cup 2, glaze 23 on the high level mark 22, and water in the cup 2, the water stream flowing out of the blow off pipe 19, water still in the blow off pipe 19, water remaining in the thermos bottle 1, the metal housing 18 of the thermos bottle 1, and resistor R1, ending at B+. As a result, the B electrode of Q1 carries a positive charge which keeps the transistors Q1 and Q2 in an ON position, and therefore the relay BZ1 keeps holding and the C and D points of relay BZ1 are disconnected to deactivate the electric air pump 11, the relay 121 (also BZ2) for the air valve 12, and the indicating lamp 13 (also LP1) to be disconnected, and therefore, the indicating lamp 13 (also LP1) extinguishes, and the relay 121 (also BZ2) for the air valve 12 is in a release state which causes the air valve 12 to open. In addition, the electric air pump 11 stops and, therefore, release of water stops, too. Since the water stream disappears, an open circuit appears at the B electrode of Q1 and the B electrode no longer carries a positive charge. However, since there is a self-holding circuit provided, points a and b of BZ1 are connected when the relay BZ1 is in a holding state, which allows the B electrode of transistor Q1 to continually carry a positive charge and therefore becomes self-holding, i.e., transistors Q1 and Q2 are still turned on and the water cutoff state stays unchanged. Then, when the cup 2 is removed, the thermos bottle 1 automatically cuts off the water and the automatic water release/cutoff power switch 15 is disconnected causing all other circuits to be disconnected. The 24V DC power supply circuit 3 is disconnected, too, and therefore, the connects a and b of the relay BZ1 separate while points C and D connect, and all circuit elements return to their original state. The same process is repeated when water is to be released next time.

Furthermore, a RESET SW is provided between B+ and relay BZ1. In the event that there is a thin layer of moistures on the inner wall of the cup 2, the moisture may form a conductor resulting in earlier cutoff of water due to formation of a circuit at the B electrode of Q1. In that event, pressing of the RESET SW disconnects the positive voltage at the collector electrode C of transistor Q2 and causes the relay BZ1 to release so that points C, D of BZ1 are connected again, and therefore the automatic water release state is recovered.

According to the above description, the present invention has at least the following features and effects:

1. The electric thermos bottle of the present invention substitutes power-pumping for hand-pumping water so that users may have water from the thermos bottle under a completely automated process, thus effectively improving the user's standard of living.

2. The electric thermos bottle of the present invention is very convenient and safe to use.

3. The electric air pumping structure provided by the present invention is proven by experience to have a life of at least two or three years while the hand-press top-head for a conventional electric thermos bottle is made of plastic and is easily hardened and broken. Therefore, the present invention may effectively lengthen the usable life of an electric thermos bottle.

We claim:

1. An electric thermos bottle capable of automatic water release and cutoff, comprising:

an insulated metal housing having a top head;

an automatic water release/cutoff power switch;

an electric air pump for pumping air through an air communicating pipe into said metal housing to cause water to exit said housing through a water exit, said air communicating pipe including a steam exhaust passage and an air valve actuated by an air valve relay for cutting off a supply of air from said pump to said housing and permitting steam in said housing to exhaust through to said exhaust passage, said pump and relay being disposed inside said top head and connected to said automatic water release/cutoff power switch by a control circuit;

a cup having an electrically conductive element arranged thereon such that when (1) said cup is placed under the water exit of said thermos bottle and on said automatic water release/cutoff power switch, (2) water is poured into said cup in response to actuation of said pump by said power switch being closed under the weight of said cup, and (3) said water poured into said cup reaches a high level mark inside said cup, then said water and conductive element together complete an automatic water cutoff circuit parallel to said control circuit to override said control circuit and cut off power to said pump while simultaneously opening said valve, thereby cutting off the supply of air to said housing while permitting steam in said housing to exhaust through said exhaust passage.

2. An electric thermos bottle capable of automatic water release/cutoff as claimed in claim 1, wherein said control circuit and said automatic cutoff circuit together share a power supply circuit, a self-holding circuit, and a noise-silencing signal circuit, said power supply circuit including a transformer, a rectifier, and a rectification capacitor connected to supply 24V DC power to a transistor switch for controlling a relay which in turn controls power input to said electric air pump, said air valve relay, and an indicating lamp, the 24V DC power supply being connected to said metal housing of said thermos bottle via a zener diode and resistor, and the base electrode being connected to said metal plate on said automatic water release/cutoff power switch via a second diode and further connected to a first terminal of said relay; said self-holding circuit comprising a second transistor which, when switched on, connects second and third terminals of said relay, thereby causing said power to be transmitted to said base electrode of the first transistor via said zener diode, said second and third terminals of said relay and said second diode permitting the base electrode to maintain a positive charge that causes both the first transistor and the second transistor to stay on, and said relay to stay in a self-holding state until said cup is removed from said switch; said noise-silencing signal circuit including a second capacitor and a third diode which form a noise filter and a shielded cable for preventing interference by noise signals which would cause the automatic water cutoff function to fail.

3. An electric thermos bottle capable of automatic water release and cutoff as claimed in claim 7, wherein a reset switch is provided in the cutoff circuit between the voltage supply and said relay such that, in the event a thin layer of moisture forms on an inner wall of said cup therefore completes a circuit with the base electrode of the first transistor, causing water cutoff before said high level mark is reached by said water poured into said cup, said reset switch causes a positive voltage on a collector electrode of the second transistor to discharge, thereby causing said relay to open and said pouring to continue until said high water mark is reached.

4. An electric thermos bottle capable of automatic water release and cutoff as claimed in claim 7, wherein a safety switch is provided on said thermos bottle by providing a double-pole switch on said power supply circuit of said automatic water release/cutoff power switch such that when said safety switch is turned off, said automatic water release/cutoff power switch is also disconnected.

5. An electric thermos bottle capable of automatic water release and cutoff as claimed in claim 1, wherein said cup is a porcelain cup having a thick layer of glaze applied on an outer bottom and a periphery thereof; and a strip of glaze about 0.5 cm in width extending upward from said outer bottom of said cup to an outer wall of said cup and crossing an upper rim of said cup, and then extending into inner wall of said cup until it reaches the high level mark inside said cup to form said electrically conductive element.

6. An electric thermos bottle capable of automatic water release and cutoff as claimed in claim 5, wherein said cup is a glass cup, and said conductor element is an alloy wire inset in the wall of said glass cup with two short lengths respectively extending from an outer bottom of said cup and the high level mark inside said cup.

* * * * *

UNITED STATES PATENT AND TRADEMARK OFFICE

CERTIFICATE OF CORRECTION

PATENT NO. : 5,332,887

DATED : July 26, 1994

INVENTOR(S) : Shiaw-Shing YUAN

It is certified that error appears in the above-indentified patent and that said Letters Patent is hereby corrected as shown below:

ON THE COVER PAGE:

Item [19] should read --YUAN--.

Item [76] should read --Shiaw-Shing Yuan--.

Signed and Sealed this

Twenty-fifth Day of April, 1995

Bruce Lehman

*Attest:*

BRUCE LEHMAN

*Attesting Officer*

*Commissioner of Patents and Trademarks*